US006815624B2

(12) United States Patent
Schultz

(10) Patent No.: US 6,815,624 B2
(45) Date of Patent: Nov. 9, 2004

(54) METHODS AND APPARATUS FOR TRANSFERRING ELECTRICAL POWER

(75) Inventor: Ronald Lloyd Schultz, Northfield, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/109,525

(22) Filed: Mar. 28, 2002

(65) Prior Publication Data

US 2003/0184421 A1 Oct. 2, 2003

(51) Int. Cl.[7] ..... H01H 9/20
(52) U.S. Cl. ..... 200/50.33; 307/64
(58) Field of Search ..... 200/401, 416, 200/428, 459, 461, 50.32–35, 32–33, 573–574; 307/64, 86; 335/68, 161

(56) References Cited

U.S. PATENT DOCUMENTS 3,697,709 A * 10/1972 Witkor ..... 200/48 R
3,936,782 A * 2/1976 Moakler et al. ..... 335/161
4,590,387 A * 5/1986 Yoshida et al. ..... 307/64
4,791,255 A * 12/1988 Eliezer ..... 218/1
5,070,252 A * 12/1991 Castenschiold et al. ..... 307/64
5,576,604 A 11/1996 Kunert et al.
5,581,133 A 12/1996 Smith et al.
5,638,948 A 6/1997 Sharaf et al.
5,748,432 A 5/1998 Przywozny et al.
5,773,983 A 6/1998 Cochran et al.
5,784,240 A 7/1998 Przywozny
5,914,467 A 6/1999 Jonas et al.
5,942,901 A 8/1999 Cochran et al.
6,172,432 B1 1/2001 Schnackenberg et al.
6,208,130 B1 3/2001 Cochran et al.
6,297,640 B1 10/2001 Hayes
6,538,223 B1 * 3/2003 Yoshida et al. ..... 200/401

* cited by examiner

*Primary Examiner*—Lincoln Donovan
(74) *Attorney, Agent, or Firm*—Armstrong Teasdale LLP

(57) ABSTRACT

A method for manufacturing a transfer switch includes providing a transfer switch including a first shunt contact and a second shunt contact, and operationally coupling a shunt solenoid to the first shunt contact and the second shunt contact such that when the solenoid is electrically activated the first shunt contact electrically couples a first source to a load and the second shunt contact electrically couples a second source to the load in a first pre-determined amount of time.

12 Claims, 4 Drawing Sheets

METHODS AND APPARATUS FOR TRANSFERRING ELECTRICAL POWER

BACKGROUND OF THE INVENTION

This invention relates generally to electrical power transfer and, more particularly, to electrical power transfer switches.

Many businesses use transfer switches to switch between power sources which supply power to the business. For example, from a public utility source to a private secondary supply. Critical equipment and businesses, such as hospitals, airport radar towers, and high volume data centers are dependent upon transfer switches to provide continuous power. More specifically, in the event that power is lost from a primary source, the transfer switch shifts the load from the primary source to an alternate source in a minimal amount of time to facilitate providing continuous electrical power to such equipment and businesses.

At least one known transfer switch utilizes a "make-beforebreak" switch to transfer the load from the primary source to the alternate source. The make before break switch includes dual main contacts which require dual shafts and a plurality of actuators. Transfer switches including dual main contacts and dual shafts may also include dual solenoids to drive the shafts. In the event one of the solenoids fails, the main contacts may remain in an undesired position thereby preventing the transfer switch from activating to enable the business to switch to an alternate power supply.

BRIEF DESCRIPTION OF THE INVENTION

In one aspect, a method for manufacturing a transfer switch is provided. The method includes providing a transfer switch including a first shunt contact and a second shunt contact, and operationally coupling a shunt solenoid to the first shunt contact and the second shunt contact such that when the solenoid is electrically activated the first shunt contact electrically couples a first source to a load and the second shunt contact electrically couples a second source to the load in a first pre-determined amount of time.

In another aspect, an apparatus for transferring power from a first source to a second source is provided. The apparatus includes a first shunt contact, a second shunt contact, and a shunt solenoid operationally coupled to the first shunt contact and the second shunt contact such that when the shunt solenoid is electrically activated the first shunt contact electrically couples a first source to a load and the second shunt contact electrically couples a second source to the load in a first pre-determined amount of time.

DETAILED DESCRIPTION OF THE INVENTION

Figure 1:
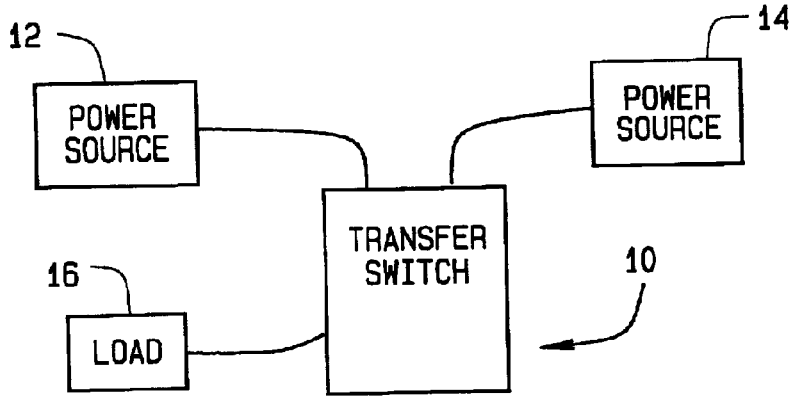
FIG. 1 is a diagram of a power system including a transfer switch.

FIG. 1 illustrates a power system 8 which includes a transfer switch 10 used to selectively switch between a plurality of power sources, e.g. between a power source 12 and a power source 14, to supply electrical power to a load 16. For example, in one embodiment, load 16 is a hospital, airport radar tower or other electrical power user that desires a substantially uninterrupted power supply. Load 16, via switch 18, draws power from source 12 under normal operating conditions. If, for example, power source 12 fails or becomes inadequate to supply load 16, load 16 is transferred via switch 18 to draw power from source 14. When source 12 again provides sufficient power, load 16 may be transferred via switch 18 to resume drawing power from source 12. The foregoing description of transfer switch 10 operation is exemplary only, and additional functions may be performed by transfer switch 10.

Figure 2:
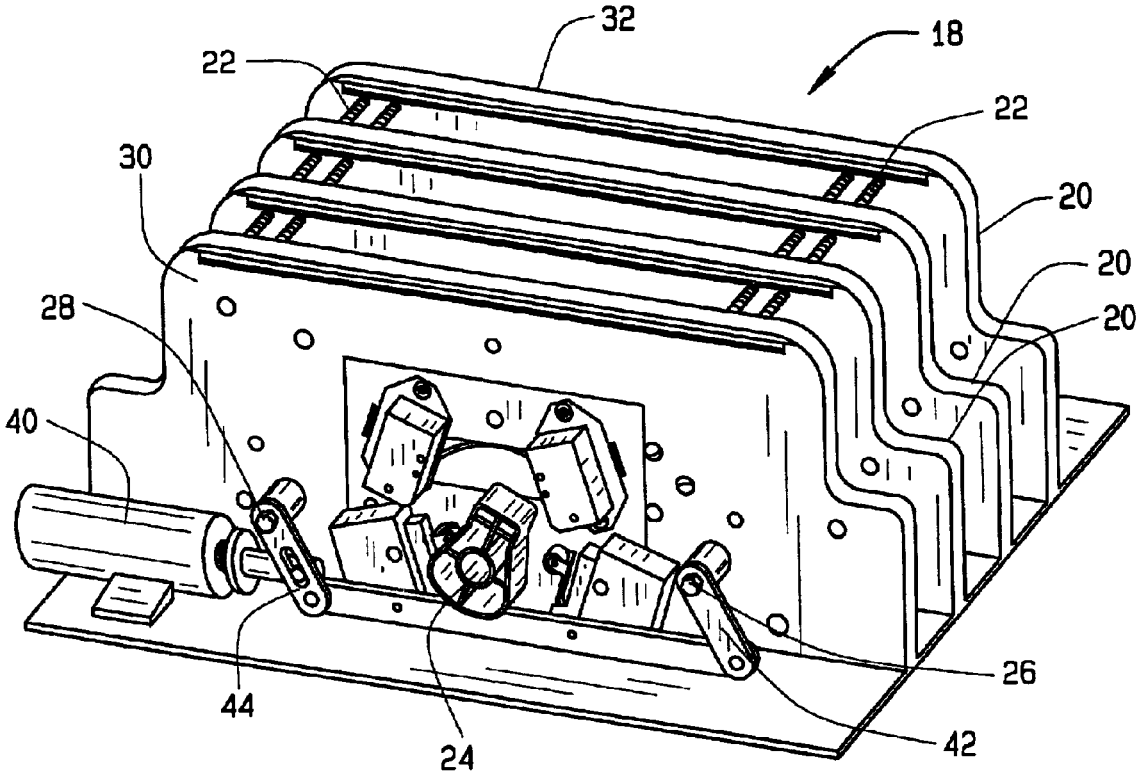
FIG. 2 is an illustration of one embodiment of a transfer switch that may be used with the power system shown in FIG. 1.

FIG. 2 is a transfer switch 18 that may be used with power system 8 (shown in FIG. 1). Transfer switch 18 includes a plurality of main contact phase compartments 20. More specifically, switch 18 includes one phase compartment 20 for each phase of power entering transfer switch 18. Compartments 20 are mechanically coupled together with a plurality of mechanical fasteners. In the exemplary embodiment, transfer switch 18 includes three phase compartments 20. Transfer switch 18 also includes a main finger shaft 24, a first shunt contact shaft 26, and a second shunt contact shaft 28. Finger shaft 24, first shaft 26 and second shaft 28 extend from a first side 30 of transfer switch 18 to a second side 32 of transfer switch 18. In one embodiment, finger shaft 24, first shaft 26 and second shaft 28 are rotatably coupled to transfer switch 18 using a mechanical fastener (not shown), such as, but not limited to, a bolt and a nut, a mechanical clip or any other suitable fastener.

Figure 3:
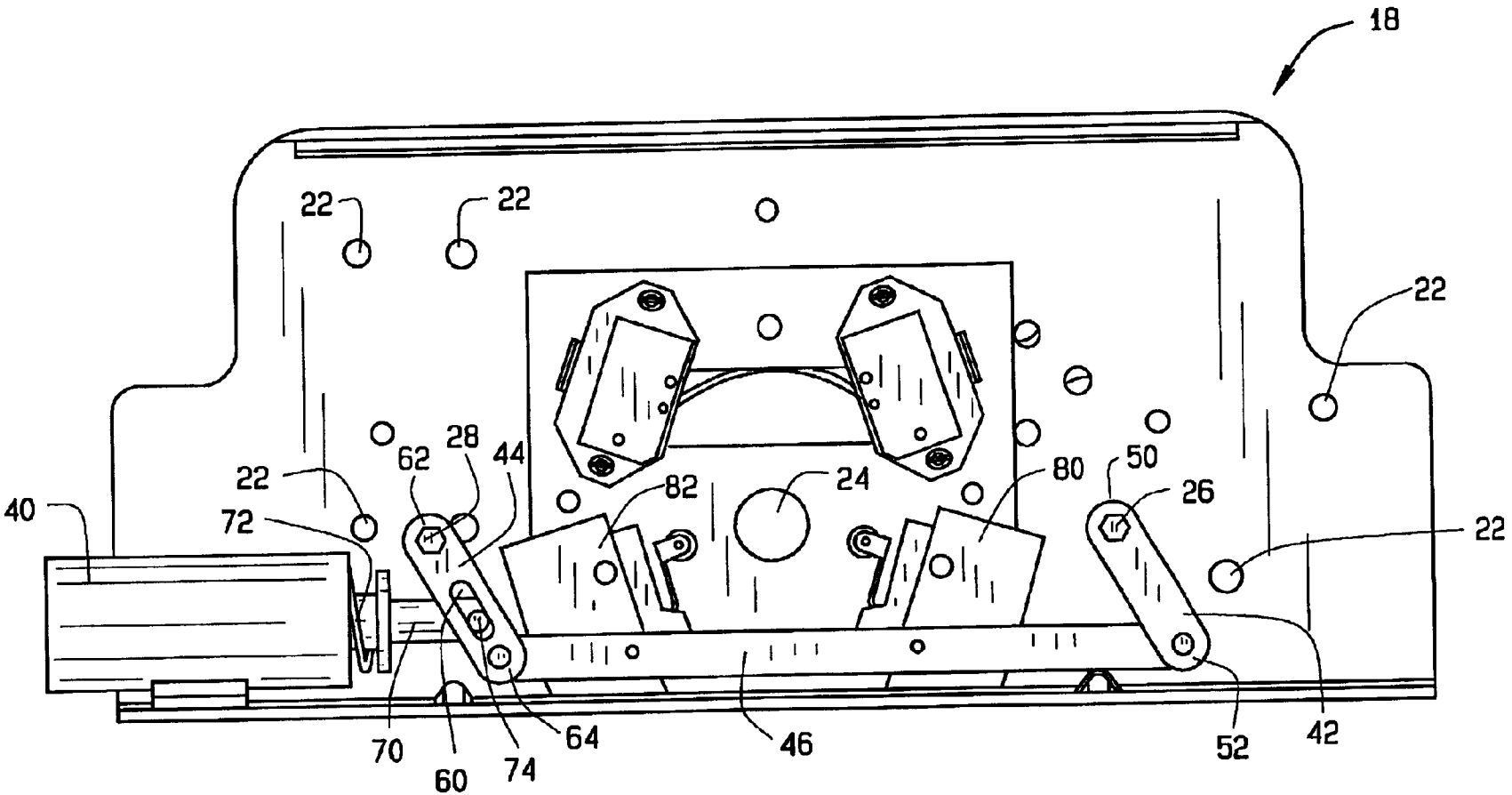
FIG. 3 is a side view of the transfer switch shown in FIG. 2.

FIG. 3 is a side view of transfer switch 18. Transfer switch 18 includes a single coil shunt contact solenoid 40 mechanically coupled to transfer switch 18, a first shunt linkage 42, a second shunt linkage 44, and a third shunt linkage 46. First shunt linkage 42 includes a first end 50 rotatably coupled to first shunt shaft 26, and a second end 52 rotatably coupled to third linkage 46. Second shunt linkage 44 includes an opening 60, a first end 62 rotatably coupled to second shunt shaft 28 and a second end 64 rotatably coupled to third linkage 46. Solenoid 40 is controlled by a controller (not shown).

Solenoid 40 includes a plunger 70 and a spring 72. Plunger 70 also includes a connector 74 which extends through opening 60 to couple connector 74 in slidable contact with second shunt shaft 28. Transfer switch 18 also includes a first limit switch 80 and a second limit switch 82 mechanically coupled to transfer switch 18.

Figure 4:
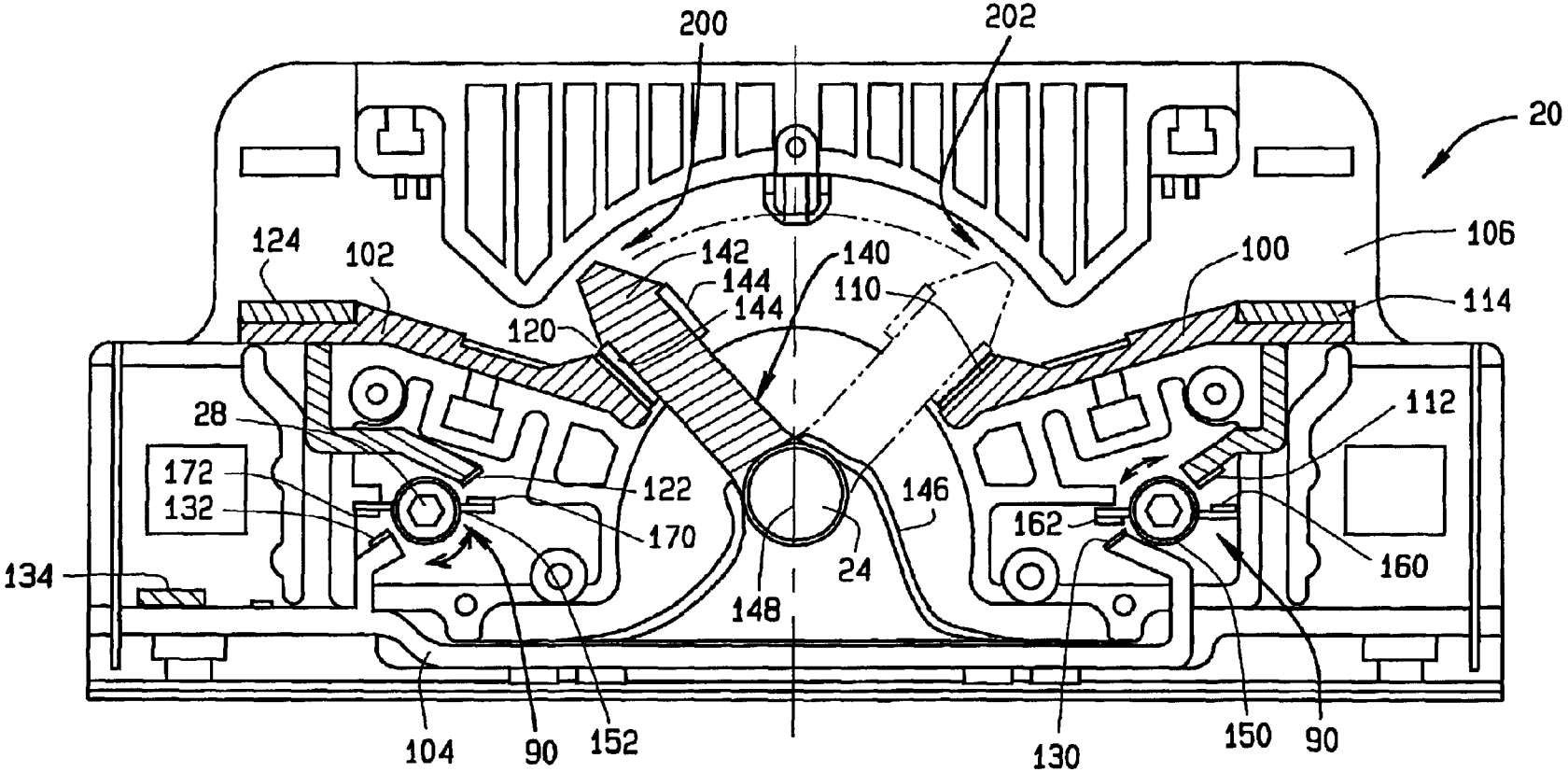
FIG. 4 is a perspective view of a portion of the transfer switch in FIG. 2 in a first operating position.
Figure 5:
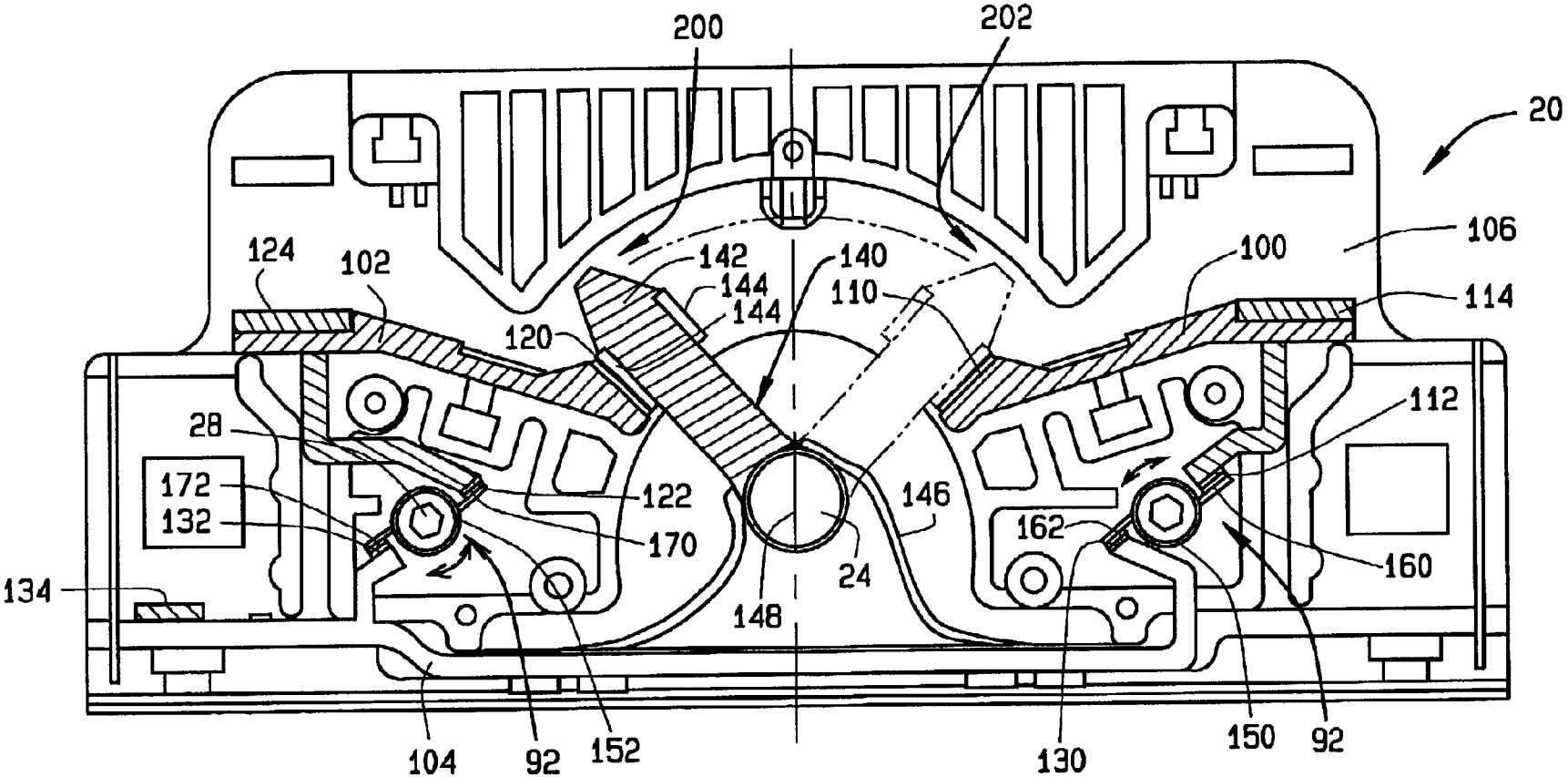
FIG. 5 is a perspective view of a portion of the transfer switch in FIG. 2 in a second operating position.

FIG. 4 is a perspective view of a portion of transfer switch 18 in a first operating position 90. FIG. 5 is a perspective view of a portion of transfer switch 18 in a second operating position 92. Phase compartment 20 includes a first source bus 100, a second source bus 102, and a load bus 104 mounted in a housing 106. In the exemplary embodiment, housing 106 is fabricated from a non-conductive material and electrically isolates each first source bus 100, second source bus 102, and load bus 104. First source bus 100 includes a first contact 110, a second contact 112, and a third contact 114 that are each electrically coupled to a power source such as source 14 (shown in FIG. 1). Second source bus 102 includes a first contact 120, a second contact 122 and a third contact 124 each electrically coupled to a source such as source 12 (shown in FIG. 1). Load bus 104 includes a first contact 130, a second contact 132, and a third contact 134 each electrically coupled to a load, such as load 16 (shown in FIG. 1).

Phase compartment 20 also includes a finger assembly 140 mechanically coupled to finger shaft 24. Finger assembly 140 includes a movable finger 142 and two contact pads 144 mounted on finger 142. Finger assembly 140 also includes an electrical conductor 146, such as a braid assembly attached to finger 142 to electrically couple finger 142 to load bus 104 as finger 142 is re-positioned. In the exemplary embodiment, finger 142 is symmetrical about a centerline 148.

Phase compartment 20 also includes a first shunt contact 150 and a second shunt contact 152 that are each positioned within phase compartment 20. First shunt 150 is mechanically coupled to first shunt shaft 26, and second shunt contact 152 is mechanically coupled to second shunt shaft 28. First shunt contact 150 includes a first contact 160 and a second contact 162. First contact 160 and second contact 162 are electrically isolated from shunt shaft 26 by an electrically non-conductive device (not shown). Second shunt contact 152 includes a first contact 170 and a second contact 172 which are electrically isolated from shunt shaft 28. In an alternative embodiment, first shunt contact 150 and second shunt contact 152 are fabricated such that electrical current is transferred through first shunt contact 150 and second shunt contact 152 without the use of contacts 160, 162, 170, and 172, respectively.

During use, when the controller senses the available power from either source 14 or source 16. More specifically, the controller monitors a phase differential between source 12 and source 14 to determine when source 12 and source 14 are in approximate synchronism and when the available power is below a pre-set value. When source 12 and source 14 are approximately in synchronism, the controller causes solenoid 40 (shown in FIG. 2) to actuate thereby retracting plunger 70 (shown in FIG. 2) into solenoid 40 to move first shunt contact 150 and second shunt contact 152 from first operating position 90 (shown in FIG. 4) to second operating position 92 (shown in FIG. 5). In first operating position 90, first shunt contact 150 and second shunt contact 152 are "open" such that contacts 150 and 152 do not conduct electricity. In second operating position 92, first shunt contact 150 rotates such that first shunt contacts 160 and 162 electrically couple with contacts 112 and 130, respectively, thereby allowing electricity to flow from first power source 12 to load 16. Additionally, second shunt contact 152 is rotated such that second shunt contacts 170 and 172 electrically couple with contacts 122 and 132, respectively, thereby allowing electricity to flow from second power source 14 to load 16. For example, retracting plunger 70 causes second shunt linkage 44 (shown in FIG. 2) to translate to move third linkage 46 (shown in FIG. 2). As third linkage 46 is re-positioned, first shunt linkage 42 (shown in FIG. 2) is rotated at approximately the same rate as second shunt linkage 44. Because first shunt contact 150 is coupled to first shunt shaft 26, and second shunt contact 152 is coupled to second shunt shaft 26, actuating solenoid 40 causes contacts 150 and 152 to translate from a non-conducting state to a conducting state to enable electricity to flow from first power source 12 to load 16 and from second power source 14 to load 16.

In the exemplary embodiment, shunt contact 150 and shunt contact 152 are rotated together such that buses 100 and 102 respectively, are electrically coupled to load bus 104 when source 12 and source 14 are approximately synchronized. Shunt contacts 150 and 152 remain in a closed position for a first pre-determined amount of time. In one embodiment, shunt contacts 150 and 152 are closed between approximately seventy five milliseconds and approximately one hundred and twenty five milliseconds. In another embodiment, shunt contacts 150 and 152 are closed approximately one hundred milliseconds.

When first shunt contact 150 and second shunt contact 152 are in the closed position, i.e. conducting electricity, a single coil solenoid (not shown) coupled to finger 142 is activated to cause finger 142 to traverse from a first finger position 200 to a second finger position 202. For example, if finger 142 is in position 200, contacts 120 and 144 are electrically coupled such that electricity flows from power source 14 to load 16. Furthermore, activating the finger solenoid causes finger 142 to traverse to position 202 such that contacts 110 and 144 are coupled to enable power to flow from source 12 to load 16.

In one embodiment, main finger 142 traverses from first finger position 200 to second finger position 202 in a second pre-determined amount of time. In one embodiment, main finger 142 traverses from first position 200 to second position 202 between approximately sixty milliseconds and approximately seventy milliseconds. In the exemplary embodiment, the first pre-determined amount of time, i.e. amount of time shunt contacts 150 and 152 remain closed, is greater than the second pre-determined amount of time, i.e. time required for main finger 142 to traverse from first position 200 to second position 202. When a main finger shaft of main finger 142 reaches second position 202, another limit switch, such as limit switch 80 or limit switch 82 signals solenoid 40 to cut off. Spring 72 then extends plunger 70 causing shunt contacts 150 and 152 to return to an "open" position. For example, if finger 142 is in position 200, when finger 142 traverses to second position 202, finger 142 depresses first limit switch 80 and power to solenoid 40 is terminated, allowing energy stored within spring 72 to force plunger 70 out of solenoid 40, thereby moving linkage 46 causing first shunt contact 150 and second shunt contact 152 to return to an open position. In another embodiment, if finger 142 is in second position 202, when finger 142 traverses to first position 200, finger 142 depresses first limit switch 82 and power to solenoid 40 is terminated, allowing energy stored within spring 72 to force plunger 70 out of solenoid 40, thereby moving linkage 46 causing first shunt contact 150 and second shunt contact 152 to return to an open position.

In the exemplary embodiment, transfer switch 18 facilitates transferring load 16 from source 12 to source 14, in phase, and without a loss of power to load 16. Furthermore, transfer switch 18 includes only the main finger shaft coil and coil of solenoid 40 which can both operate as an open or a closed transition switch. In the event of a shunt contact failure, switch 18 can continue to operate as an open transition switch. Additionally, shunt contacts 150 and 152 are not required to be the same ampacity as the main contacts, nor have a load breaking or an arc quench capability.

Transfer switch 18 is adaptable for a two-pole, a three-pole, and a four-pole modular configuration with minimal additional hardware. Symmetrical and one-piece design of parts such as compartments 20 facilitate reducing a number of components, thus facilitating cost reductions.

Additionally, transfer switch 18 facilitates reducing the inertia of a shunt contact train. For example, during a closed transition operation without direct frequency control of the alternate source, the alternate source, typically a generator set, is usually set to a tenth of a hertz higher than the alternate source (a utility). An electronic controller monitoring the phase differential between the primary source and the alternate source will determine when the two are in synchronism. At that point a shunt signal will be issued causing the load to be connected to both the primary source and the alternate source and the main finger to transfer. Since shunt contacts 150 and 152 are physically smaller than bus 100 and bus 102, shunt contacts 150 and 152 facilitate shunting the circuit more rapidly. Therefore, a length of time before shunting with a subsequent shifting to a more out of phase condition is reduced. This is beneficial to the load not seeing an electrical anomaly.

While the invention has been described in terms of various specific embodiments, those skilled in the art will recognize that the invention can be practiced with modification within the spirit and scope of the claims.

What is claimed is:

1. An apparatus for transferring power from a first source to a second source, said apparatus comprising:

a first shunt contact;

a second shunt contact;

a shunt solenoid operationally coupled to said first shunt contact and said second shunt contact such that when said shunt solenoid is electrically activated said first shunt contact electrically couples a first source to a load and said second shunt contact electrically couples a second source to said load, wherein both said first and second sources are coupled to said load for a first pre-determined amount of time during which said first and second shunt contacts remain closed; and a controller configured to provide a command that initiates movement of said first and second shunt contacts when said first and second sources are in synchronism with each other.

2. An apparatus in accordance with claim 1 further comprising at least one phase compartment, wherein said first shunt contact and said second shunt contact are positioned within said phase compartment.

3. An apparatus in accordance with claim 2 wherein said phase compartment comprises a first bus larger than said first shunt contact, and a second bus larger than said second shunt contact.

4. An apparatus in accordance with claim 2 further comprising a first shunt shaft, a second shunt shaft, and a main finger shaft of a main finger, wherein said first shunt shaft, said second shunt shaft, and said main finger shaft are rotatably coupled with said phase compartment.

5. An apparatus in accordance with claim 4 wherein said first shunt shaft is mechanically coupled to said first shunt contact, said second shunt shaft is mechanically coupled to said second shunt contact, and said main finger shaft is mechanically coupled to a main finger contact.

6. An apparatus in accordance with claim 4 further comprising a first shunt linkage rotatably coupled to said first shunt shaft, a second shunt linkage rotatably coupled to said second shunt shaft, and a third linkage rotatably coupled to said first shunt linkage and said second shunt linkage.

7. An apparatus in accordance with claim 6 wherein said shunt solenoid is slidingly coupled with said second shunt linkage.

8. An apparatus in accordance with 5 further comprising a main finger solenoid mechanically coupled to said main finger such that said finger solenoid moves said main finger from a first position to a second position in a second pre-determined amount of time less than said first amount of time.

9. An apparatus in accordance with claim 1 further comprising a limit switch electrically coupled to said shunt solenoid, said limit switch configured to deactivate said shunt solenoid when depressed by a main finger.

10. An apparatus in accordance with claim 1 wherein said shunt solenoid further comprises a spring configured to move said first shunt contact and said second shunt contact to an open position when said solenoid is deactivated.

11. An apparatus in accordance with claim 5 further comprising an electrical connector movably attached to said main finger such that said finger is electrically coupled to a load bus in a plurality of finger positions.

12. An apparatus for transferring power from a first source to a second source, said apparatus comprising:

a first shunt contact;

a second shunt contact;

at least one phase compartment, wherein said first shunt contact and said second shunt contact are positioned within said phase compartment;

a shunt solenoid operationally coupled to said first shunt contact and said second shunt contact such that when said shunt solenoid is electrically activated said first shunt contact electrically couples a first source to a load and said second shunt contact electrically couples a second source to said load, wherein both said first and second sources are coupled to said load for a first pre-determined amount of time during which said first and second shunt contacts remain closed; and a main finger solenoid mechanically coupled to a main finger such that said finger solenoid moves said main finger from a first position to a second position in a second pre-determined amount of time less than said first amount of time.

* * * * *